United States Patent [19]

Ishizuka et al.

[11] Patent Number: 4,815,362

[45] Date of Patent: Mar. 28, 1989

[54] DIFFUSER UNIT FOR AIR CONDITIONING SYSTEM

[75] Inventors: Yutaka Ishizuka, Konan; Masanori Kaizaki, Kawasaki; Shigeo Tanaka, Ageo, all of Japan

[73] Assignee: Diesel Kiki Co., Ltd., Tokyo, Japan

[21] Appl. No.: 125,985

[22] Filed: Nov. 27, 1987

[30] Foreign Application Priority Data

Dec. 1, 1986 [JP] Japan ..... 61-185198

[51] Int. Cl.[4] ..... F24F 13/06

[52] U.S. Cl. ..... 98/41.1; 98/40.12; 98/40.17; 98/DIG. 10; 137/875

[58] Field of Search ..... 98/2.14, 40.11, 40.12, 98/40.17, 41.1, 40.5, DIG. 10; 231/49; 137/870, 871, 875

[56] References Cited

U.S. PATENT DOCUMENTS 2,320,007 5/1943 Otto ..... 98/41.1

4,535,932 8/1985 Herb ..... 98/40.17 X

FOREIGN PATENT DOCUMENTS 2033194 1/1972 Fed. Rep. of Germany ..... 98/40.11

*Primary Examiner*—Harold Joyce

*Attorney, Agent, or Firm*—Wenderoth, Lind & Ponack

[57] ABSTRACT

A diffuser unit for air conditioning systems includes an air supply duct having an air inlet and two air outlets, two dampers for adjusting the open area of the respective air outlets, and a linkage mechanism interconnecting the dampers and a drive unit. The dampers include arcuate end portions for contacting an inner wall of the duct and for preventing the generation of wind noise from air being supplied through the duck. The linkage mechanism is so constructed as to displace a selected one of the dampers while holding the other damper in its closed position.

5 Claims, 2 Drawing Sheets

DIFFUSER UNIT FOR AIR CONDITIONING SYSTEM

BACKGROUND OF THE INVENTION

1. Field of the Invention

The present invention relates to a diffuser unit for air conditioning systems adapted to be mounted on the sidewall or ceiling of a house or building, a vehicle or the like.

2. Prior Art

A diffuser unit of this type is disclosed in Japanese Utility Model Laid-open Publication No. 60-34009. The disclosed diffuser unit includes an air supply duct having two air outlets adapted to be selectively opened and closed by a single damper disposed in the duct. When one of the air outlets is closed by the damper, the temperature controlled air is supplied solely from the other air outlet. When the damper is turned to an intermediate position, the air is blown-off from both air outlets. In this instance, the ratio of the flow rate of blown-off air from the one air outlet to the flow rate of blown-off air from the other air outlet is proportional to the angular position of the damper.

In an application in which the diffuser unit is mounted on the ceiling of a house or building, it is highly desirable that one of the air outlets is selected depending on the desired air conditioning mode and cold air or hot air is blown-off exclusively from the selected air outlet at a controlled flow rate while closing the other air outlet, thereby increasing the air conditioning efficiency.

However, such desirable air conditioning is not attained by the known diffuser unit described above because the flow rate of blown-off air from each respective air outlet is not controlled independently. Any angular movement of the damper to adjust the flow rate of blown-off air from the selected air outlet will necessarily cause the non-selected air outlet to be partially opened, thereby letting cold air or hot air pass through the non-selected air outlet. Due to this unintended air distribution, an efficient air conditioning is difficult to achieve.

SUMMARY OF THE INVENTION

It is accordingly an object of the present invention to provide a diffuser unit for air conditioning systems which is capable of adjusting the flow rate of blown-off air while directing a stream of blown-off air to a desired direction.

The foregoing and other objects are attained by a diffuser unit for air conditioning systems, comprising:

- an air supply duct having an air inlet and two air outlets;
- two dampers for regulating the open area of the two air outlets; and
- a linkage mechanism operatively connecting the dampers with a drive means for moving a selected one of said two dampers while holding the other damper in its closed position.

With this construction, only the selected damper is angularly moved to adjust the flow rate of blown-off air passing therethrough. Furthermore, the air outlets are opened and closed independently from one another. The open area of each air outlet is variable with the angular displacement of a rocking plate.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A preferred embodiment of the present invention is described below with reference to the accompanying drawings.

Figure 1:
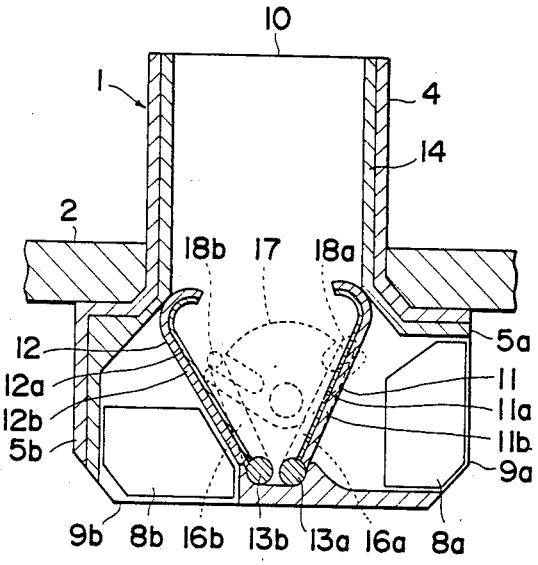
FIG. 1 is a cross-sectional view taken along line I—I of FIG. 2, showing a diffuser unit according to the present invention.
Figure 2:
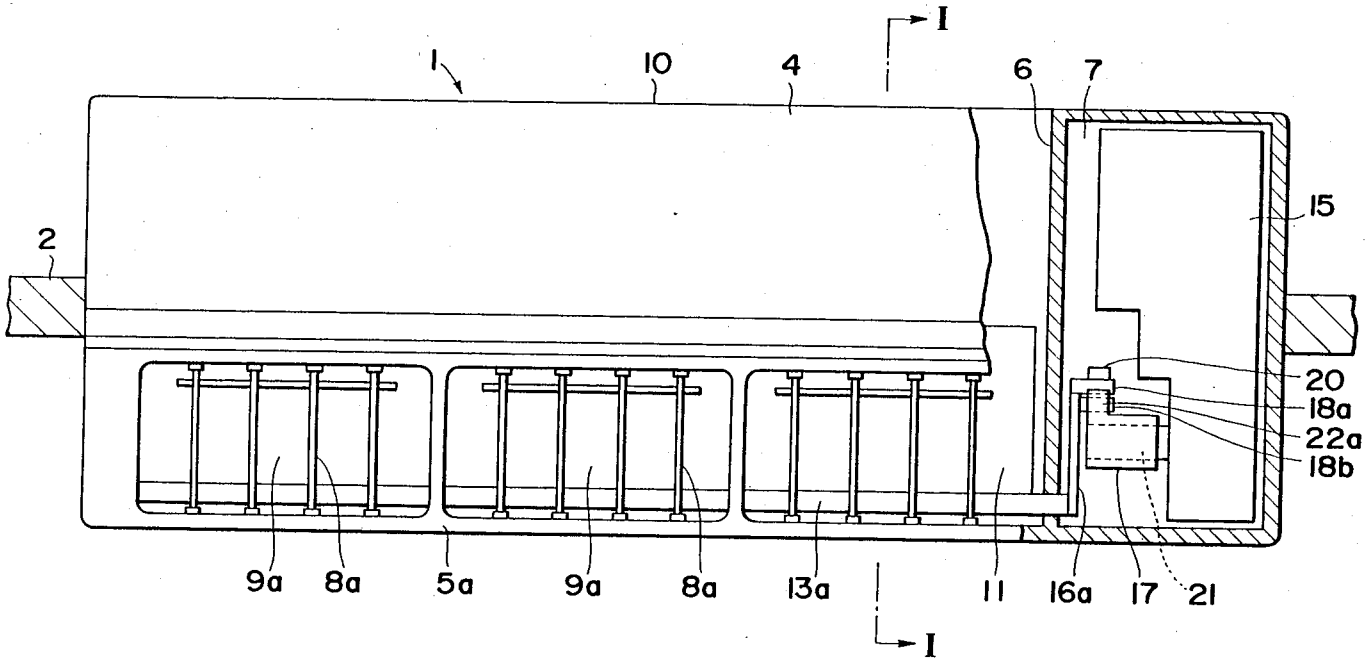
FIG. 2 is a front elevational view, with part cut-away for clarity, of the diffuser unit.

As shown in FIGS. 1 and 2, a diffuser unit embodying the invention includes an air supply duct 1 mounted on the ceiling 2 of a house or a vehicle. The duct 1 has an elongate hollow body of a generally T-shaped cross section and includes an air intake portion 4 projecting through the ceiling 2 into a space above the ceiling 2, a pair of first and second air discharge portions 5*a*, 5*b* extending contiguously from an inner end of the air intake portion 4 in substantially opposite directions and overlying the inner surface of the ceiling 2, and a power unit chamber 7 defined at an end of the duct 1 and separated from the discharge portions 5*a*, 5*b* by a partition wall 6. The first discharge portion 5*a* has a first air outlet 9*a* facing in a direction parallel to the general plane of the ceiling 2. Likewise, the second discharge portion 5*b* has a second air outlet 9*b* facing in a downward direction perpendicular to the general plane of the ceiling 2. A plurality of parallel spaced first baffle plates 8*a* are disposed in the first discharge portion 5*a* adjacent to the first air outlet 9*a*. A plurality of parallel spaced second baffle plates 8*b* are disposed in the second discharge portion 5*b* adjacent to the second air outlet 9*b*. The air intake portion 4 has an air inlet 10 facing in an upward direction perpendicular to the general plane of the ceiling 2. The temperature controlled air supplied from a non-illustrated air conditioning unit is introduced through the air inlet 10 into the duct 1. The air is then blown-off from a selected one of the air outlets 9*a*, 9*b* in which instance the direction and the flow rate of blown-off air are adjusted by first and second dampers 11, 12.

Each of the first and second dampers 11, 12 is composed of a damper body 11*a*, 12*a* and a cushioning member 11*b*, 12*b* overlying the damper body 11*a*, 12*a*. The dampers 11, 12 are connected at one end to a pair of parallel spaced drive shafts 13*a*, 13*b*, respectively, pivotably disposed between the first and second air outlets 9*a*, 9*b*. The other or distal end of each damper 11, 12 is bent arcuately so as to prevent the generation of wind noise. The arcuate portion of the distal end of the damper 11, 12 is sealingly engageable with a lining 14 of the duct 1 when the damper 11, 12 is held in its closed position. The dampers 11, 12 are normally urged toward their closed positions by means of torsion springs (not shown) disposed around the respective drive shafts 13*a*, 13*b* and acting between the duct 1 and the dampers 11, 12. The dampers 11, 12 are operatively connected with a drive means or unit 15 via a linkage mechanism described later on.

Figure 3:
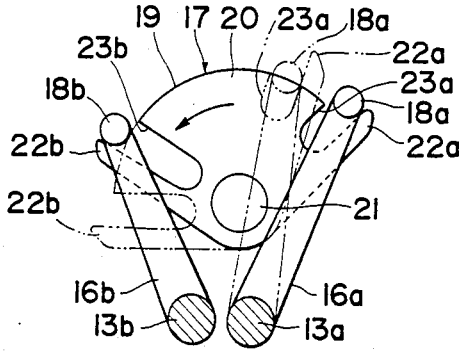
FIG. 3 is an enlarged view showing a linkage mechanism of the diffuser unit.

The linkage mechanism includes first and second levers 16*a*, 16*b* operatively connected with the first and second dampers 11, 12, respectively, and movable in unison with the latter, and a rocking plate 17 coupled with the levers 16*a*, 16*b*. The levers 16*a*, 16*b* are connected with ends of the respective drive shafts 13*a*, 13*b* extending through the partition wall 6 into the power unit chamber 7. The levers 16*a*, 16*b* extend perpendicular to the axes of the drive shafts 13*a*, 13*b* and have lateral pins projecting perpendicularly from the distal end of the levers 16*a*, 16*b*. As best shown in FIG. 3, the rocking plate 17 is in the form of a sector and connected at its lower end to a dirve shaft 21 of the drive unit 15 such as a reversible motor actuator. The rocking plate 17 thus connected is turned about the drive shaft 21 in opposite directions when the motor actuator 15 is energized. The rocking plate 17 includes a central sector portion 20 having an arcuate peripheral edge 19, first and second radial arms 22*a*, 22*b* disposed on opposite sides of the sector portion 20 and projecting radially outwardly beyond the arcuate peripheral edge 19, and first and second radial grooves 23*a*, 23*b* defined respectively between the first arm 22*a* and the sector portion 20 and between the second arm 22*b* and the sector portion 20, the radial grooves 23*a*, 23*b* being contiguous to the arcuate peripheral edge 19.

The rocking plate 17 is disposed in confronting relation to the first and second levers 16*a*, 16*b* in such a manner that the arcuate peripheral edge 19 of the sector portion 20 slidingly engages the lower surfaces of the pins 18*a*, 18*b* on the levers 16*a*, 16*b* upon angular movement of the rocking plate 17. When the dampers 11, 12 are disposed in their closed positions, the pins 18*a*, 18*b* on the respective levers 16*a*, 16*b* are held in abutment with corresponding arms 22*a*, 22*b*. When the rocking plate 17 is turned in one direction, one of the pins 18*a*, 18*b* is forced by the corresponding arm 22*a*, 22*b* to move into the radial groove 23*a*, 23*b* while the other pin 18*b*, 18*a* slides along the arcuate peripheral edge 19 of the sector portion 20.

As described above, the dampers 11, 12 are normally held in closed positions. When the rocking plate 17 is turned in a direction indicated by the arrow shown in FIG. 3, the pin 23*a* on the first lever 16*a* is guided into the raidal groove 23*a*. At the same time, the lever 16*a* is tilted in the same direction as the rocking plate 17, thereby progressively opening the first outlet 9*a* to an extent proportional to the tilted position of the damper 11. During that time, the pin 18*b* on the second lever 16*b* slides along the arcuate peripheral edge 19 of the sector portion 20 with the result that the second damper 12 remains immovable in its closed position.

With this arrangement, the opening area of one air outlet is adjusted independently from the other outlet. One of the air outlets 9*a*, 9*b* is selected according to the temperature of air, i.e. the desired air conditioning mode.

For instance, when cold air is supplied to the duct, the first air outlet 9*a* is opened. The cold air is therefore blown-off from the first air outlet 9*a* along the ceiling 2 at a flow rate proportional to the angular position of the damper 11, i.e. the open area of the first air outlet 9*a*. Conversely, when the supplied air is hot, the second air outlet 9*b* is opened. The hot air is blown-off from the second air outlet in a downward direction at a flow rate proportional to the angular position of the damper 12, namely the open area of the second air outlet 9*b*.

It is possible, according to the invention, to vary the position of the dampers 11, 12 in a stepwise manner. Further, the pivot angle of the rocking plate 17 may be adjusted depending on the temperature of a room to be air-conditioned. The levers 16*a*, 16*b* may be connected to a single drive shaft. As a further alternative, the levers 16*a*, 16*b* may be connected directly to the respective dampers 11, 12.

Obviously, various modifications and variations of the present invention are possible in the light of the above teaching. It is therefore to be understood that within the scope of the appended claims the invention may be practiced otherwise than as specifically described.

What is claimed is:

1. A diffuser unit for air conditioning systems, comprising:

(a) an air supply duct having an air inlet and two air outlets;

(b) two dampers for regulating the open area of said two air outlets, each said damper being substantially straight and having an arcuate portion at the distal end thereof, the arcuate surface of said arcuate portion being engageable with an inner wall of said duct, and each said arcuate portion preventing the generation of noise from air being supplied through said duct; and (c) a linkage mechanism operatively connecting said dampers with a drive means for displacing a selected one of said two dampers while holding the other damper in its closed position.

2. A diffuser unit for air conditioning systems, comprising:

(a) an air supply duct having an air inlet and two air outlets;

(b) two dampers for regulating the open area of said two air outlets; and (c) a linkage mechanism operatively connecting said dampers with a drive means for displacing a selected one of said two dampers while holding the other damper in its closed position, said linkage mechanism including (i) two levers secured respectively to said dampers and having pins, and (ii) a rocking plate connected in driving relation to said levers and including (a) a central sector portion having an arcuate peripheral edge, (b) a pair of radial arms disposed on opposite sides of said sector portion and projecting radially outwardly beyond said arcuate peripheral edge for defining jointly with said sector portion a pair of radial grooves contiguous to said arcuate peripheral edge, and (iii) said rocking plate being angularly movable for causing one of said arms to force a corresponding one of said pins into one of said radial grooves adjacent to said one arm while keeping the other pin in sliding engagement with said arcuate peripheral edge of said sector portion.

3. A diffuser unit according to claim 2, each said damper having an arcuate distal end engageable with an inner wall of said duct.

4. A diffuser unit according to claim 2, one of said dampers and one of said levers being connected with a first drive shaft, the other damper and the other lever being connected with a second drive shaft.

5. A diffuser unit according to claim 4, said first and second drive shaft are disposed being biased toward an air outlet which is opening in a horizontal direction from a central axis of said air supply duct.

* * * * *